US005225620A

United States Patent [19]

Terada

[11] Patent Number: 5,225,620

[45] Date of Patent: Jul. 6, 1993

[54] ELECTRONIC MUSICAL INSTRUMENT HAVING ONE-TOUCH MULTITRACK RECORD AND PLAYBACK OF AUTOMATIC PERFORMANCE

[75] Inventor: Kosei Terada, Hamamatsu, Japan

[73] Assignee: Yamaha Corporation, Hamamatsu, Japan

[21] Appl. No.: 706,242

[22] Filed: May 28, 1991

[30] Foreign Application Priority Data

May 31, 1990 [JP] Japan ..... 2-144133

[51] Int. Cl.[5] ..... G10H 1/38; G10H 7/00

[52] U.S. Cl. ..... 84/609; 84/613; 84/DIG. 22

[58] Field of Search ..... 84/601-614, 84/634-643, DIG. 12, DIG. 22, DIG. 29

[56] References Cited

U.S. PATENT DOCUMENTS 3,781,452 12/1973 Vauclain ..... 84/DIG. 29
3,810,106 5/1974 Nadler et al. ..... 84/609 X
4,899,632 2/1990 Okamura ..... 84/601
5,038,660 8/1991 Watanabe ..... 84/601

*Primary Examiner*—Stanley J. Witkowski
*Attorney, Agent, or Firm*—Graham & James

[57] ABSTRACT

An electronic musical instrument comprises record designating device for designating a record mode, a playing data memory having a plurality of recording tracks, a record mode setting device for specifying a first predetermined track and for setting the first predetermined track to a record mode, and a play mode setting device for specifying a second predetermined track and for setting the second predetermined track to a play mode. When the record mode setting device is simultaneously operated with the record designating device, it allows the first predetermined track to be specified and set to the record mode simultaneously. Further, when the play mode setting device is operated, it allows the second predetermined track to be specified and set to the play mode simultaneously.

10 Claims, 16 Drawing Sheets

<Registers>

| | | |
|---|---|---|
| SPLIT | = | NORMAL mode...0 |
| | | SPLIT mode ...1 |
| CHORD | = | Type of chord |
| ROOT | = | Root of chord |
| MOD | = | NORMAL mode...0 |
| | | WAIT mode ...1 |
| | | RUN mode ...2 |
| TR | = | Track No. |
| TRMOD (TR) | = | STOP mode ...0 |
| | | REC mode ...1 |
| | | PLAY mode ...2 |
| TIMING | = | Count of timing |
| STYL | = | Style No. of rhythm |
| VOICE | = | Tone color No. |
| RYTM | = | NORMAL mode ...0 |
| | | Rhythm RUN mode ...1 |
| EVNT (TR) | = | Event data |
| TM(TR) | = | Timing data |
| SV | = | VOICE input mode ...0 |
| | | STYL input mode ...1 |

ELECTRONIC MUSICAL INSTRUMENT HAVING ONE-TOUCH MULTITRACK RECORD AND PLAYBACK OF AUTOMATIC PERFORMANCE

BACKGROUND OF THE INVENTION

1. Field of the Invention

The present invention relates to an electronic musical instrument, such as a sequencer or a synthesizer, provided with a playing-data memory for storing playing-data for each track.

2. Description of the Prior Art

An electronic musical instrument such as a sequencer has at least a playing-data memory for storing playing-data for each track, a track switch for specifying a track, and a mode switch for setting a specified track to the REC (record) mode or PLAY mode, wherein first a track is specified with the track switch and then the specified track is set to the REC mode or PLAY mode. In such a conventional electronic musical instrument having an arrangement as above, there are provided the track switch for specifying a track and the mode switch for setting a mode, each independently, the operating procedure thereof being such that a desired track is specified with the track switch and thereafter a mode is set for the specified track with the mode switch.

However, electronic musical instruments with the above-described arrangement have suffered from disadvantages in operation involved when melodies and chords are simultaneously recorded to a plurality of tracks or when a plurality of tracks are simultaneously played back. To set a plurality of tracks to the REC mode, for example, it was necessary to take a sequence of operating steps for each track, that is, to specify a track for the first one with the track switch and successively set the track to the REC mode with the mode switch. Also, to set a plurality of tracks to the PLAY mode, it was required to first specify a track with the track switch and successively set the specified track to the PLAY mode, which sequence of operating steps was needed for each of the plurality of tracks.

SUMMARY OF THE INVENTION

The object of the present invention is therefore to provide an electronic musical instrument capable of setting a predetermined plurality of tracks to the REC mode or a specified track to the PLAY mode with one-touch operation.

According to an aspect of the present invention, there is provided an electronic musical instrument comprising:

- a playing-data memory for storing playing-data for each track;
- a track switch for specifying a track;
- a mode switch for setting the specified track to the REC (record) mode or PLAY mode;
- one-touch REC-mode setting means for specifying a predetermined plurality of tracks and setting them to the REC mode with one-touch operation; and
- means for writing or reading playing-data into or from the specified track according to a set mode.

According to another aspect of the present invention, there is provided an electronic musical instrument comprising:

- a playing-data memory for storing playing-data for each track;
- a track switch for specifying a track;
- a mode switch for setting the specified track to the REC (record) mode or PLAY mode;
- one-touch PLAY-mode setting means for specifying a certain track and setting it to the PLAY mode; and
- means for writing or reading playing-data for a specified track according to a set mode.

In an electronic musical instrument according to the present invention, to execute the normal operation in the REC mode or PLAY mode, an arbitrary track is specified with the track switch and moreover the specified track is set to the REC mode or PLAY mode with the mode switch. These operations with the track switch and mode switch are rendered to all tracks to be set to the REC mode or PLAY mode. On the other hand, to set a predetermined plurality of tracks to the REC mode, the one-touch REC-mode setting means is handled. This handling is effected only with one-touch operation. For example, if the predetermined plurality of tracks are the first track (1st track) and the third track (3rd track), this operation with the one-touch REC-mode setting means causes the 1st and 3rd tracks to be immediately specified and moreover these tracks to be set to the REC mode. This operation with the one-touch REC-mode setting means is convenient to set a predetermined plurality of tracks to the most typical, frequently-used mode. For example, although the most typical REC-mode pattern in an electronic musical instrument is that one track is set to the REC mode for melodies while another track is set to the REC mode for chords, the one-touch operation with the one-touch REC-mode setting means will make the mode setting operation immediately completed. Moreover, if the one-touch REC-mode setting means is substituted by the one-touch PLAY-mode setting means, one-touch operation with the one-touch PLAY-mode setting means will allow a certain track (e.g. a track in which playing-information is already stored) to be specified and set to the PLAY mode at the same time.

The above and other objects, features and advantages of the present invention will become more apparent from the following detailed description with reference to the accompanying drawings.

DESCRIPTION OF THE PREFERRED EMBODIMENTS OF THE INVENTION

Figure 1:
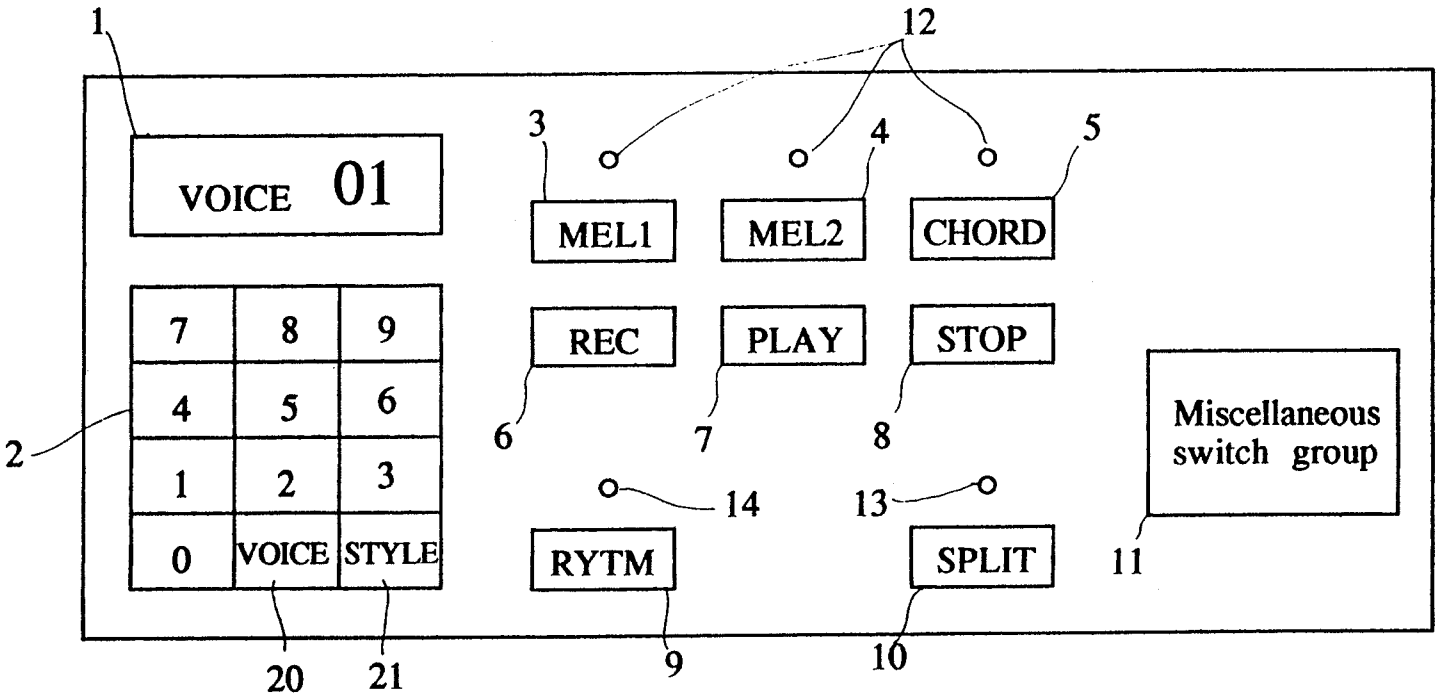
FIG. 1 is a view illustrating a control panel of a synthesizer according to the present invention.

An embodiment of the invention will now be described in detail with reference to the drawings concerned. Throughout the accompanying drawings, like parts are designated by like reference numerals.

FIG. 1 illustrates a control panel of a synthesizer of an embodiment of the present invention. The control panel comprises a ten-key, input various types of switches and a display portion. On the upper left of the control panel there are disposed a display 1 and thereunder a ten-key input 2. Further, on the right side of the display 1 there are provided three track switches 3, 4, 5 and three mode switches 6, 7, 8, and, on the right side of the ten-key 2, a rhythm switch (RYTM switch) 9 and a split switch (SPLIT switch) 10. Further on the right side thereof there are disposed a miscellaneous switch group 11. Still more, above the track switches 3, 4, 5 there are provided LEDs 12, respectively, and above the RYTM switch 9 an LED 14, above the SPLIT switch 10 an LED 13.

In the present embodiment, the total number of tracks assigned to the playing-data memory is three. Each of the tracks is previously assigned such that the 1st and 2nd tracks are for melodies and the 3rd track for chords. Each of the track switches 3 to 5 is a toggle switch, with such an arrangement that an LED 12 corresponding thereto is made lit or blinking thereby to display the specification of a related track and a set mode. The track switch 3 serves to specify the 1st track for melodies, the track switch 4 to specify the 2nd track for melodies, and the track switch 5 to specify the 3rd track for chords.

The mode switches disposed below the above-mentioned track switches comprise a REC switch 6, a PLAY switch 7, and a STOP switch 8. The REC switch 6 serves to set a track specified with one of the track switches to the REC mode. Specifying a track and setting the REC mode are accomplished by simultaneously depressing both the REC switch 6 and a desired track switch.

The PLAY switch 7 has a function a little different from that of the REC switch 6. That is, specifying a track and setting the PLAY mode are not accomplished by simultaneously depressing the PLAY switch 7 and a track switch. The arrangement of the present embodiment enables only operation of the track switch to specify a track and set the PLAY mode. More specifically, the track switches 3 to 5 serve, respectively, both as a track switch for specifying a track and as a mode switch for setting the specified track to the PLAY mode. In the embodiment presented here, the PLAY switch 7 is given a function for specifying all tracks that have ever been in record state and setting them to the PLAY mode.

It is to be noted here, however, that the PLAY switch 7 may of course be adapted to serve as a mode switch for setting a track to the PLAY mode like the REC switch 6. In this case, the arrangement will be such that specifying a track and setting the PLAY mode are accomplished by simultaneously depressing both the PLAY switch 7 and a track switch.

In this embodiment, the STOP switch 8 is also provided in addition to the above-mentioned mode switches. The STOP switch 8 allows a stop mode to be set.

The RYTM switch 9 disposed below the foregoing mode switches 6 to 8 is a toggle switch that allows a rhythm tone to be started or stopped. The SPLIT switch 10 further provided is a toggle switch, like the RYTM switch 9, that can switch over the keyboard mode between the NORMAL mode and the SPLIT mode. The SPLIT mode means that the keyboard is split into two, i.e. the left-side key range, from playing-data in which a chord is detected to determine the key for automatic accompaniment, and the right-side key range, playing-data in which is processed as melody data. The NORMAL mode does not involve such division, all playing-data being processed as melody data.

The ten-key mentioned above comprises a VOICE key 20 and a STYLE key 21. The VOICE key 20 is used to set a tone color in combination with the ten-key, while the STYLE key 21 is used to determine the style (i.e. rhythm pattern) in combination with the ten-key. The display 1 is used to set the VOICE or STYLE with these keys.

In the control panel arranged as described above, operations for specifying tracks and setting modes are carried out in the following manners.

(1) REC Mode (i) REC switch 6+a track switch

In this case, to specify the 1st track and set it to the REC mode, both the REC switch 6 and the track switch 3 are simultaneously depressed. Likewise, to specify the 2nd track and set it to the REC mode, both the REC switch 6 and the track switch 5 are simultaneously depressed.

In this embodiment, however, it is arranged that recording cannot be done simultaneously to the 1st and 2nd tracks. After specifying the 1st track with the REC mode set, specifying the 2nd track and setting it to the REC mode will cause the 1st track to be automatically set to the STOP mode.

(ii) REC switch 6+PLAY switch 7

This one-touch operation, when effected, will cause the 1st and 3rd tracks to be specified and also set to the REC mode. In this embodiment, out of the 1st to 3rd tracks, the 1st and 3rd tracks are previously specified. Further, since the 3rd track is assigned to one for chords in the embodiment, the one-touch operation causes the SPLIT mode to be automatically set. Accordingly, it follows that playing-data played in the left-side key range of the keyboard is converted into chord data, while playing-data played in the right-side key range is processed as melody data.

Incidentally, when the track specification and mode setting is completed through the above steps (i) and (ii), the synthesizer goes into a wait state, which is a state in which the synthesizer is in the WAIT mode. In this WAIT mode, if the keyboard is operated or the PLAY switch 7 is turned on, the recording will start from then.

(2) PLAY Mode (i) Track switches 3 to 5

The operation of only a track switch will cause a track to be specified and the specified track to be set to the PLAY mode. In the present embodiment, as stated above, the track switches 3 to 5 serve also as a mode switch for setting the PLAY mode. For example, when the track switch 3 is operated, the 1st track is specified and the PLAY mode is also set at the same time. When the PLAY mode is set, the synthesizer goes into the WAIT mode. In this WAIT mode, if the keyboard is operated or the PLAY switch 7 is turned on, the playback will start from then.

(ii) PLAY switch 7

The one-touch operation with the PLAY switch 7 will cause the track currently being in record state to be automatically selected out of the 1st to 3rd tracks and set to the PLAY mode. Also in this case, the synthesizer goes into the WAIT mode, in which if the keyboard is operated or the PLAY switch 7 is turned on, the playback will start from then.

(3) STOP MODE

While the REC mode or PLAY mode is not set, the synthesizer is in the STOP mode. If the STOP switch 8 is depressed with the REC mode or PLAY made, the synthesizer goes into the STOP mode. The LED 12 is adapted to keep out in the STOP mode, blinking in the REC mode, and lit in the PLAY mode.

Figure 2:
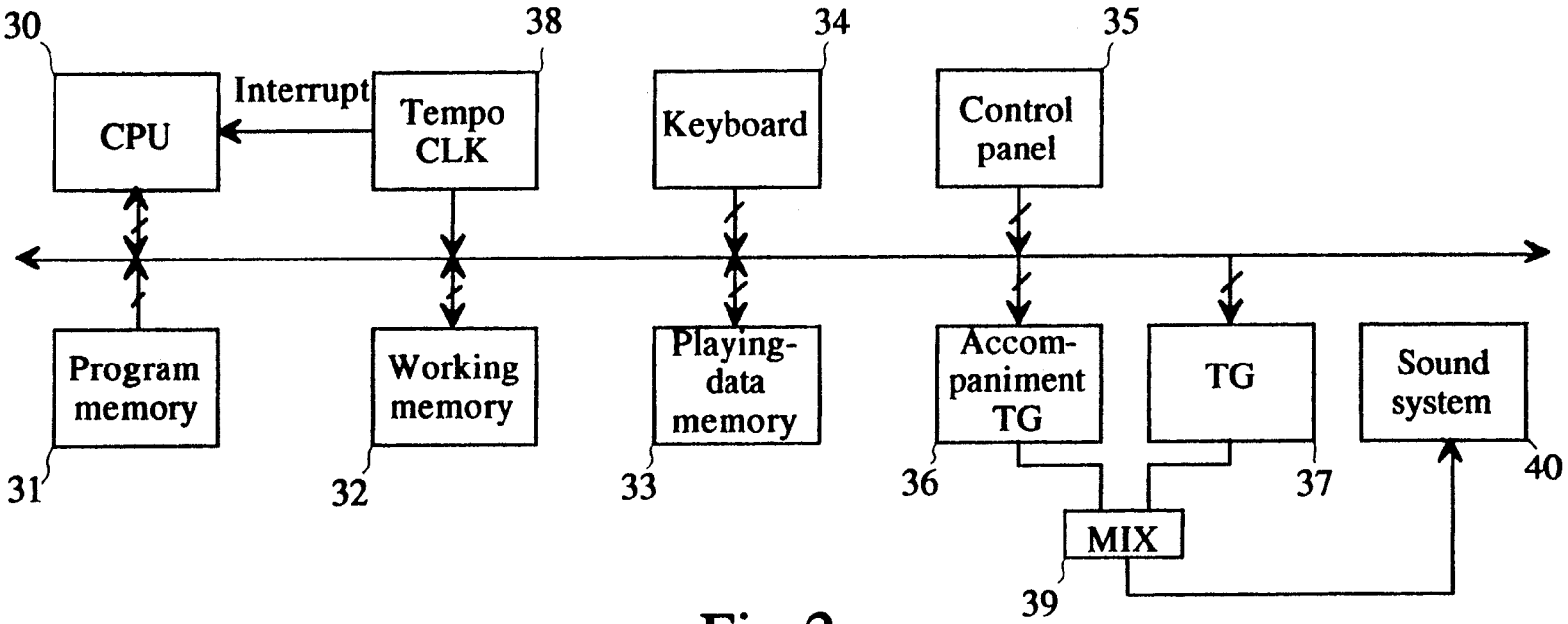
FIG. 2 is a block diagram of the same synthesizer.

FIG. 2 is a block diagram of the above-mentioned synthesizer.

The memory comprises a program memory 31, a working memory 32, and a playing-data memory 33. To a CPU 30 are connected these memories, a keyboard 34, a control panel 35 as shown in FIG. 1, an accompaniment tone generator 36, which forms accompaniment tone signals, a tone generator 37, which forms tone signals according to playing-data, and a tempo clock circuit 38. Outputs of the accompaniment tone generator 36 and the tone generator 37 are mixed in a mixer 39, and fed to a sound system 40. Meanwhile, the tempo clock circuit 38 applies interrupt to the CPU 30 for regular time intervals (every ⅛ beats). Each time the CPU 30 receives this interrupt, with the PLAY mode, it makes a decision whether or not it is the timing for executing the event data read from the playing-data memory 33 (i.e. the timing for output to the tone generator 37). Then, if it is the timing, the CPU 30 puts out the event data to the tone generator 37.

With the REC mode, on the other hand, a tone color number input through the control panel 35 as well as playing-data incoming from the keyboard 34 will be stored as event data into a pertinent track in the playing-data memory 33 in succession.

Figures 3, 4:
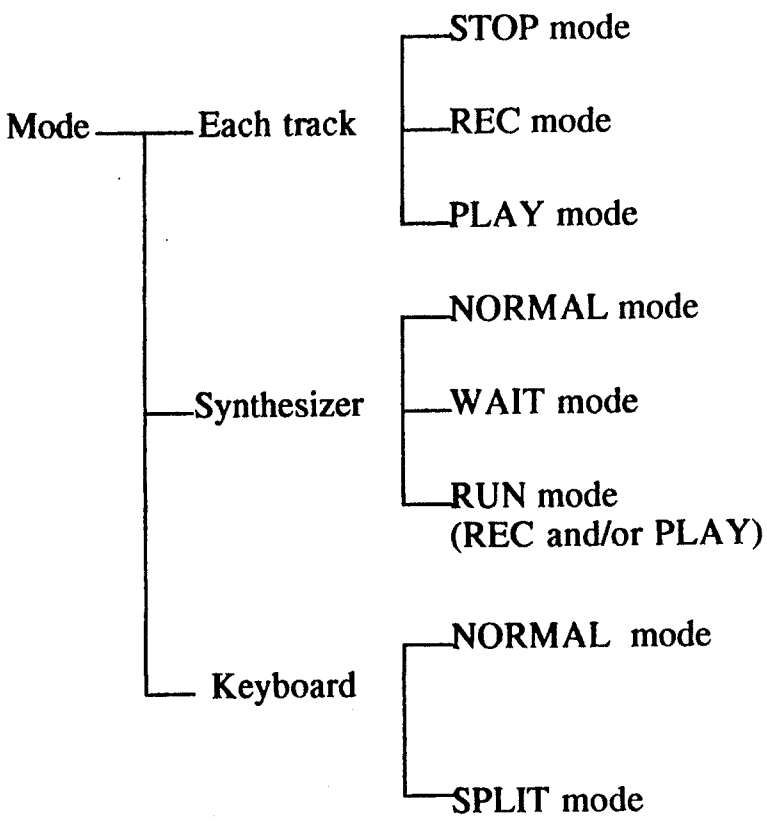
FIG. 3 is a chart showing the main set modes of the same.
FIG. 4 is a list showing various types of registers to be assigned to a working memory 32.

FIG. 3 shows the types of modes for each track assigned to the playing-data memory 33, the synthesizer, and the keyboard.

As shown therein, each track is set to either of the STOP mode, REC mode, and PLAY mode, while the synthesizer is set to either of the NORMAL mode, WAIT mode, and RUN mode. The RUN mode is a mode that is set with the operation of RECORD-(recording operation) or that of PLAY (playback operation) in actual progress. In addition, in more detail, the NORMAL mode and RUN mode out of the modes of the synthesizer can be set each independently with regard to accompaniment tones.

FIG. 4 shows registers assigned to the working memory 32. In the left-side column there are listed the names of registers and, in the right-side column, set data and the meanings thereof.

Figure 5:
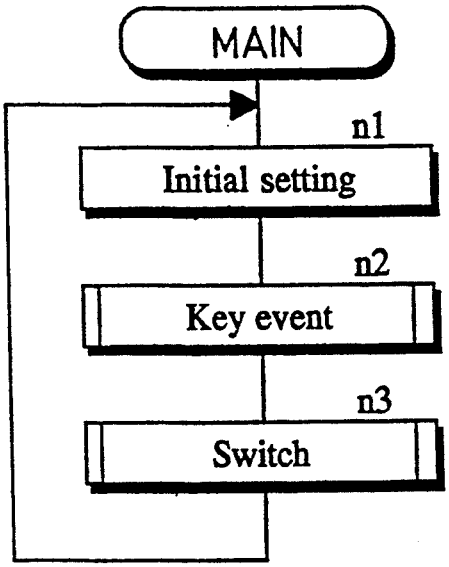
FIGS. 5 through 15 are flow charts showing operations of the synthesizer.

FIGS. 5 and following are flow charts showing practical operations of the CPU 30. These operations of the CPU 30 will now be described below with reference thereto.

FIG. 5 is the main routine.

First, at step n1, initial setting of various registers and others are performed. In this step, end codes are written to all of the playing-data memory 33. Then, with this initial setting over, subroutines at steps n2 and n3 are executed repeatedly. The n2 is a subroutine for key event processing and the n3 is that for switches.

Figure 6:
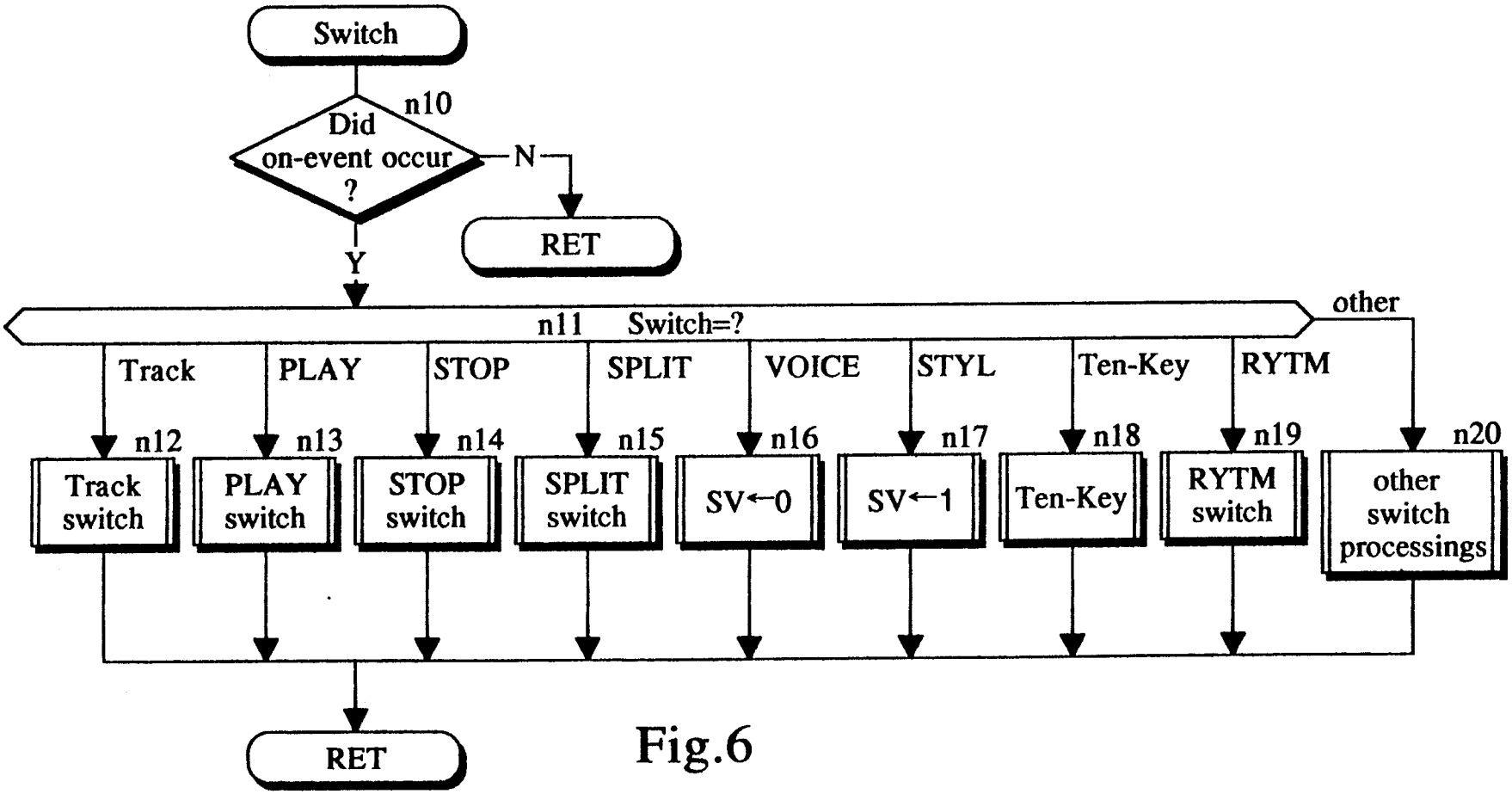

Referring first to the switch subroutine in FIG. 6, detection of switch-on-event is performed at step n10. Through this on-event detection, the switch generated the on-event is decided, and processes for each switch are performed at steps n12 to n20.

Figure 7:
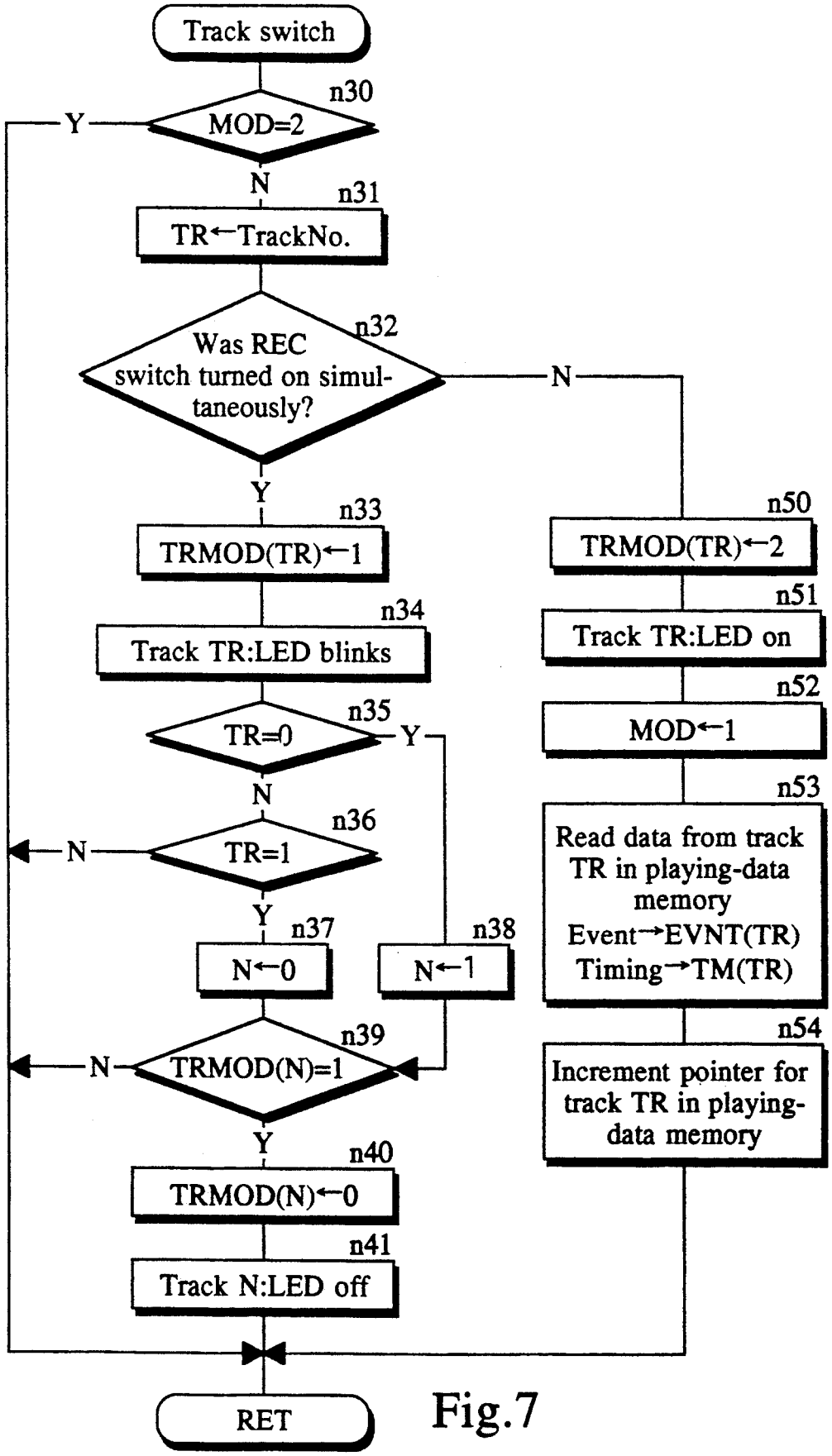

When any of the track switches 3 to 5 is operated, the subroutine for track switches at step n12 is executed. FIG. 7 details this track switch subroutine.

The step n30 is to check the register MOD. By reference to FIG. 4, MCD=2 shows that the synthesizer is in the RUN mode. With the RUN mode effective, the subroutine of FIG. 7 is left out as it is. That is, any operation of a track switch is not accepted in the RUN mode. This arrangement serves as a prevention against such a malfunction that a track is abruptly changed in the course of recording or playback. With the RUN mode ineffective, i.e. in the NORMAL mode or WAIT mode, the processing goes to the following step, n31. In this step, a track number specified with a track switch is set to a register TR. Subsequently, it is decided whether the REC switch 6 is turned on at the same time or not (n32). If any of the track switches 3 to 5 and the REC switch 6 are simultaneously turned on, the result is that a specified track is set to the REC mode. This is followed by execution of the steps n33 and following. On the other hand, if only any of the track switches 3 to 5 is turned on, the result is that a specified track is set to the PLAY mode. In the present embodiment, operation of a mode switch is not required to set a specified track to the PLAY mode. That is, when only a track switch is operated, specifying the track and setting the PLAY mode for the track are accomplished at a time. The steps of n50 and following given in FIG. 7 are to prepare for setting the specified track to the PLAY mode and also setting the synthesizer to the WAIT mode.

The steps of n33 and following are carried out in the following manner.

First, at step n33, the specified track is set to the REC mode, that is, "1" is set to a register TRMOD (TR). This operation means that the REC mode has been set (see FIG. 4). Subsequently, the LED 12 corresponding to the specified track is made to blink. The blinking of the LED 12 represents that the specified track has been set to the REC mode. In this embodiment, however, it is inhibited to simultaneously set the 1st and 2nd tracks, which can store melody data, to the REC mode. This arrangement is intended to avoid complicated processings. Therefore, at steps n35 through n41 it is inhibited to simultaneously set the 1st and 2nd tracks for melodies to the REC mode. More specifically, at steps n35 through n38, if the specified track is the 1st (TR=0) or 2nd (TR=1), register N is set to "1" or "0", respectively, and then at step n39, using the content of this register N as an argument, it is decided whether the one of the 1st and 2nd tracks other than specified is in the REC mode or not. The track other than specified, if in the REC mode, is set from the REC mode to STOP mode (n40). Further, the LED corresponding thereto is made to go out (n41). Still further, if the track other than specified is not set to the REC mode, the processing returns from n39. In other words, at the above-mentioned steps n35 through n41, it is checked whether the one of the 1st and 2nd tracks for melodies other than specified has been set to the REC mode or not, and if it has been set to the REC mode, the track is forcedly set to the STOP mode. This allows such control that only the specified track is set to the REC mode.

At the above step n32, if the REC switch 6 is not turned on at the same time, i.e. if the specified track is set to the PLAY mode, first the specified track is set to the PLAY mode at step n50. That is, "2" is set to the register TRMOD (TR) (see FIG. 4). Then, the LED 12 corresponding to the specified track is lit, while "1" is set to the register MOD. At this stage, the PLAY mode is set to the specified track, and the synthesizer is set to the WAIT mode. Further, to prepare for playback operation, the first reading of data is done from the specified track in the playing-data memory 33, with event data and timing data set to a register EVNT (TR) and a register TM (TR), respectively. In these processes, the playing-data to be recorded to each track is given in the so-called event form (a form in combination between event data and timing data). It is also arranged that the pointer for the specified track in the playing-data memory 33 is incremented by one at step 54.

In FIG. 6, if the PLAY switch 7 is decided as the on-event switch, the processing moves to the PLAY switch subroutine at step n13. The PLAY switch subroutine is given in FIG. 8. When the PLAY switch 7 is turned on, first the register MOD is decided (n60), that is, it is decided whether the synthesizer is in the RUN mode or not, where the RUN mode is a mode in which the REC mode or PLAY mode is actually running. If not, it is decided whether the synthesizer is in the WAIT mode or in the NORMAL mode (n61). Subsequently, if the NORMAL mode is effective, it is further decided whether the REC switch 6 has been turned on simultaneously with the PLAY switch 7 (n62). If it has been done, predetermined tracks are automatically specified and set to the REC mode, as described in the foregoing paragraph (1) (ii). The steps of n70 and following are to perform the operations mentioned so far. On the other hand, if the REC switch 6 is not simultaneously turned on at step n62, i.e. if the PLAY switch 7 has been turned on in the NORMAL mode, the track under recording is automatically selected and set to the PLAY mode, while the synthesizer goes into the WAIT mode, as shown in the foregoing paragraph (2) (ii). The steps n63 and following are to execute this operation.

Meanwhile, if it is in the WAIT mode that the PLAY switch 7 is turned on at the above step n61, playback or recording operation is started on the track being set to the PLAY mode or REC mode. The steps of n90 and following are to execute this operation.

First described is the operation involved when the PLAY switch 7 and the REC switch 6 are simultaneously turned on in the NORMAL mode, that is, the operation at steps 70 and following.

In this case, "1" is first set to the register MOD, with the syuthesizer set to the WAIT mode. Further, "0" is set to the register TR, while the 1st track for melodies is specified. Subsequently, it is decided whether the track specified at step n71 is the 2nd track for melodies (TR=1) or not. Since TR=0 at first, the processing goes to step n72, where the 1st track for melodies is set to the REC mode, that is, "1" is set to the register TRMOD (TR). Further, the LED 12 corresponding to the specified track is made to blink (n73). Still further, the track number specified by the register TR is incremented by one at step n74, the processing returning to step n71 again. With TR=1 set as a result of advancing the track number by one, the processing goes to step n76, where the set mode of a track specified by the register TR is decided. If the track is in the REC mode, i.e. if TRMOD (TR)=1, the processing goes to step n77, forcing the track to be set to the STOP mode. Further, the LED 13 corresponding to the track is made to go out at step n78. This arrangement is due to the fact that the 2nd track for melodies is inhibited from being set to the REC mode when the 1st track for melodies has been set to the REC mode. Subsequently, the track number to be specified by the register TR is incremented by one again at step n74. With TR=2, the track is also set to the REC mode at steps n72 and n73. Then, with TR=3, the processing jumps to step n79. Through these steps, the 1st track for melodies and the 3rd track for chords out of the three tracks are automatically specified and also automatically set to the REC mode. Moreover, at steps n79 to n81, "1" is set to the register SPLIT (n 80) and the LED 13 is lit (n81), thus setting the keyboard to the SPLIT mode.

Next the operation involved when only the PLAY switch 7 is turned on in the NORMAL mode, i.e. the case in the above paragraph (2) (ii) will be described below.

In this case, the steps of n63 and following are executed. First, it is decided whether any track to be in record state exists or not (n63). If there is no such track, the processing returns as it is. If there is such track, conversely, "1" is set to the register MOD, with the synthesizer set to the WAIT mode. Further, the initial value "0" is set to the register TR, taking the track first specified by the register TR as the 1st track. Then, it is decided whether the track specified by the register TR is to be in record state or not at step n65. If the track is in record state, the track is set to the PLAY mode (n66), causing the LED 13 corresponding thereto to be lit (n67). These steps of n65 to n67 are effected until the state TR=3 is obtained, that is to all of the 1st to 3rd tracks.

In the above operation, when the PLAY switch 7 is turned on in the NORMAL mode, a track to be in record state is automatically specified and set to the PLAY mode. Furthermore, the synthesizer is set to the WAIT mode.

The description now turns to the operation involved when the PLAY switch 7 is turned on in the WAIT mode, that is, the operation of starting recording and playback in the above paragraphs (1) and (2). In this case, the steps of n90 and following are executed.

First, at n90, "2" is set to the register MOD, and the whole system is set to the RUN mode, whereby the WAIT mode moves into the RUN mode, making the running state effective to actually operate playback in progress. More specifically, the initial value of the register TIMING for counting the timing is set to "0", while the pointers for all the tracks in the playing-data memory 33 are set to the leading head (n91). Then, the first playing-data in the specified track is read out, event data is set to the register EVENT (TR), and timing data is set to the register TM (TR), with the pointer of the specified track incremented by one (n92, n93). After the first playing-data is set to the registers as above, when the timing data of the register TIMING coincides with the timing data of the register TM at the interrupt timing to the CPU30, the event data is put into execution. This execution of event data is, for example, that of note-on (equivalent to the key-on with the keyboard), that of note-off, and the like.

Figure 8A:
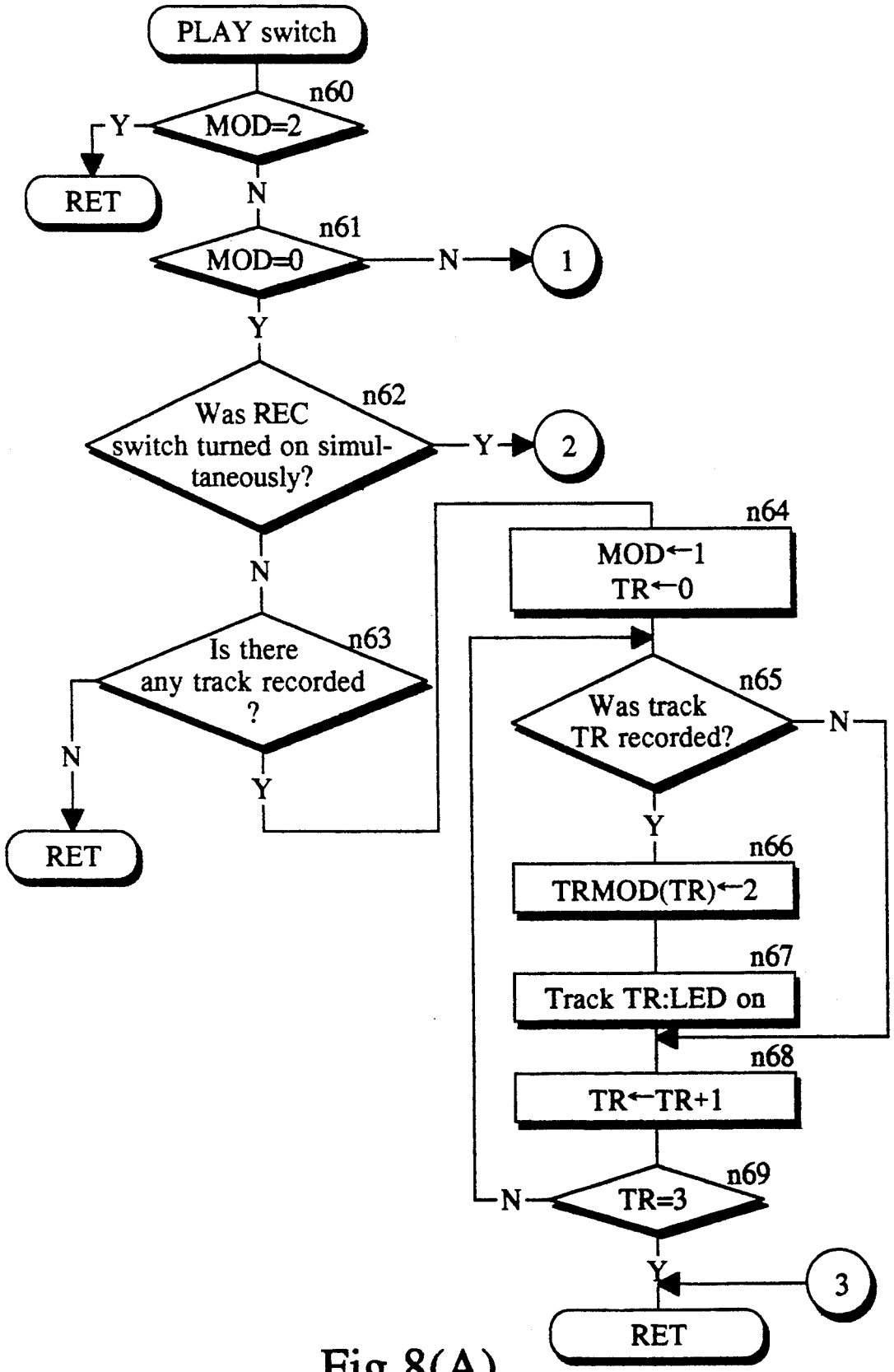
Figure 8B:
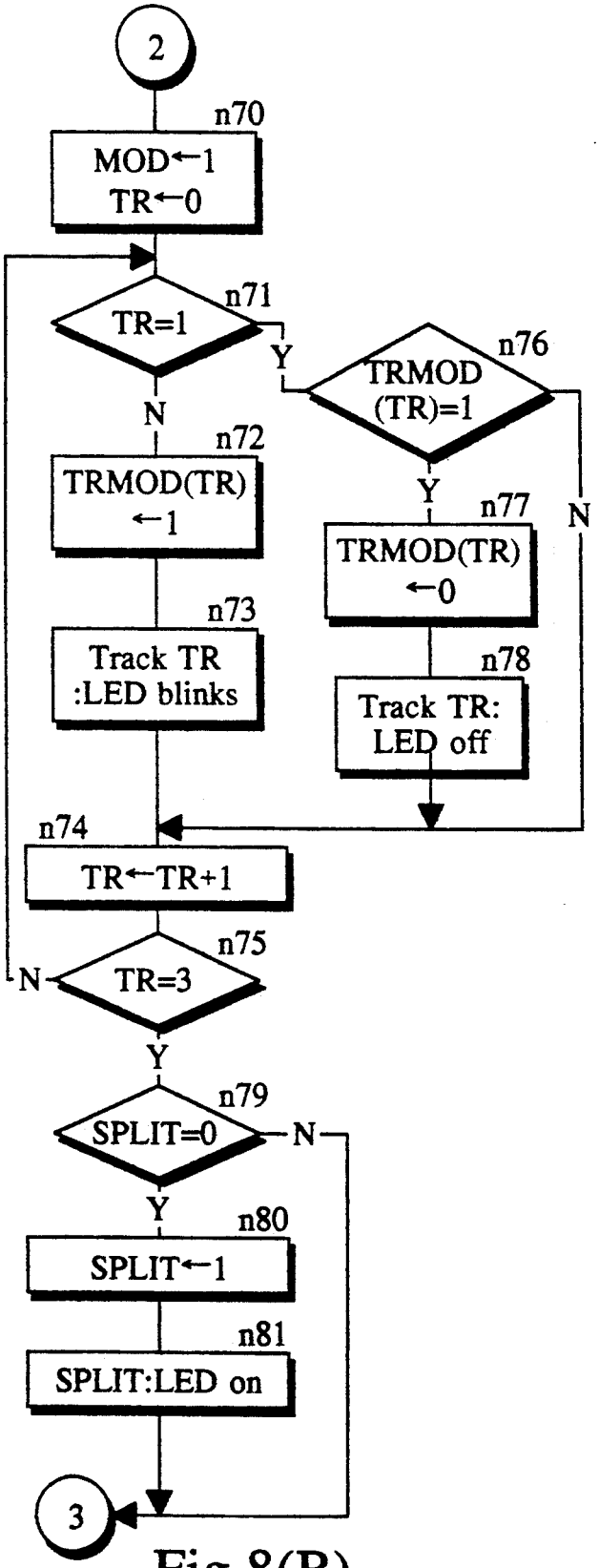
Figure 8C:
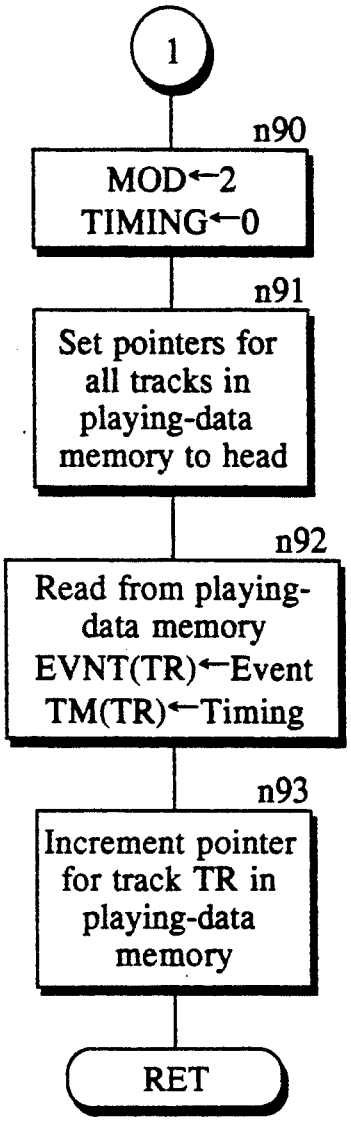

As described above, through the operations of subroutines shown in FIG. 8, each operation in the paragraphs (1) (ii), (2) (i), and (2) (ii) can be realized.

Figure 9:
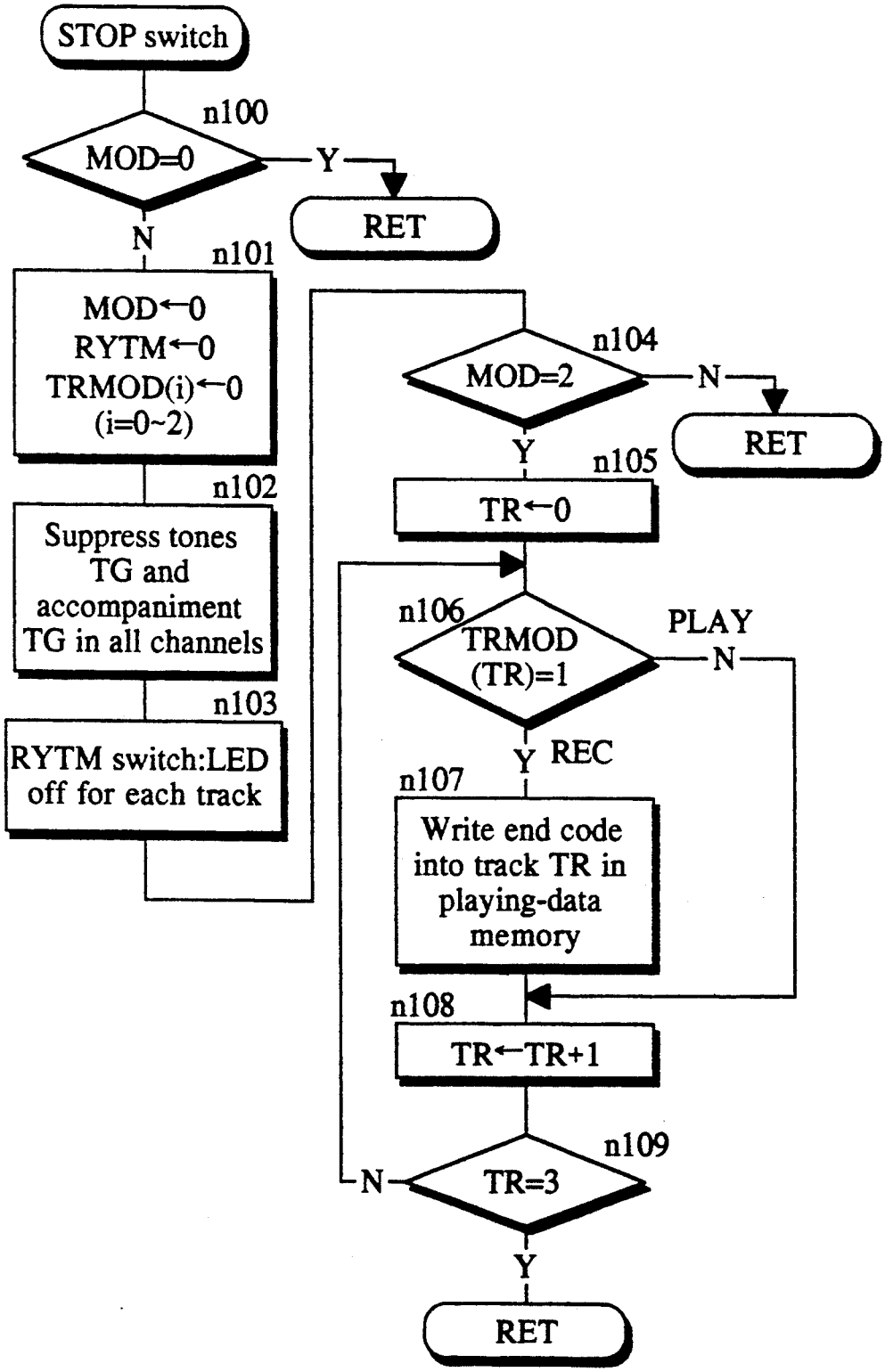

Now the description is directed to the operation involved when the STOP switch 8 is turned on. When an on-event of the STOP switch 8 is detected, the STOP switch subroutine is executed which is shown by n14 in FIG. 6. The STOP switch subroutine is as shown in FIG. 9.

When the STOP switch 8 is turned on, the synthesizer is set to the NORMAL mode, each track is set to the STOP mode, and sounds in all the channels are suppressed. Moreover, when the STOP switch 8 is turned on in the running (RUN) state in the REC mode, the processing is executed that the end code is written into all the tracks in the playing-data memory 33.

First, at step n100, the register MOD is decided. If MOD=0 (NORMAL mode), the processing returns as it is. If the register MOD is at "1" or "2", i.e. in the WAIT mode or RUN mode, the processing goes to step n101, setting the register MOD to "0" and the synthesizer to the NORMAL mode. Further, "0" is set to the register RYTM, and the rhythm state to the NORMAL mode. Still further, "0" is set to all the registers TRMOD (TR) representing the track mode. Then, at n102, sound suppression control is effected to all the channels of the tone generator 37 and accompaniment tone generator 36, while the LED 12 showing the mode setting state for each track and the LED 14 for the RYTM switch (n102, n103). Subsequently, it is decided whether the register MOD is at "2" or not. If MOD=2, the synthesizer is in the RUN mode. In this case where the synthesizer is in the RUN mode, the processing is executed at steps n105 and following that the end code is written into each track in the playing-data memory. First, at step n105, "0" is set to the register TR, taking the track specified by the register TR as the 1st track. Then it is decided at step n106 whether the 1st track has been set to the REC mode. If the 1st track is in the REC mode, the end code is written into the end of the pertinent track at step n107. At the succeeding step n108, the track specified by the register TR is incremented by one, followed by the checking at step n106 and the write operation of the end code at step n107. Through the above steps, when the STOP switch 8 is turned on in the running (RUN) state in the REC mode, write operation of the end code is effected to all tracks which are set to the REC mode. Accordingly, to terminate the recording of playing-data, turning on this STOP switch 8 allows the end code to be automatically written into the end of the track to which the playing-data is recorded.

Next, the operation involved when the ten-key 2 including the VOICE key 20 and STYLE key 21 is operated will be described below. When the VOICE key 20 is turned on, the step n16 in FIG. 6 is executed, that is, "0" is set to the register SV. With reference to FIG. 4, the state of SV=0 represents a state in which the voice input mode is effective. Further, when the STYLE key 21 is turned on, the step n17 in FIG. 6 is executed, that is, "1" is set to the register SV. With reference to FIG. 4, the state of SV=1 represents a state in which the style input mode is effective. When operation of any of the numerical keys 0 to 9 is effected, the ten-key subroutine at step n18 in FIG. 6 is executed. The ten-key subroutine at step n18 is given in FIG. 10.

First, at step n120, the register SV is decided, where SV=0 represents that the voice input mode is effective and SV=1 does the style input mode effective. For the voice input mode, the steps of n121 and following are executed. That is, the numerical value input with a numerical key is set to the register VOICE, sound suppression is effected to all channels, and the data in the VOICE is fed as a tone color number to the tone generator TG 37, with the corresponding VOICE data (tone color number) displayed on the display 1 (n121 to n124). Then the melody track write subroutine at step 125 is executed. Incidentally, in this melody track write subroutine, as will be described later, event data is written (i.e. stored) into the 1st or 2nd track of the memory. Since event data is tone color event data, tone color event data is written in the memory track write subroutine at this step n125.

When SV=1, i.e. the style input mode is effective at the above-mentioned step n120, the steps of n126 and following are executed. More specifically, input numerical data is set to the register STYL, and a style number as data of the register STYL is fed to the accompaniment tone generator 36 (n127). Further, at step n128, it is decided whether or not the register MOD is at "2" and the register TRMOD (2) is at "1", that is, whether the 3rd track for chords has been set to the REC mode with the RUN mode effective. That is, when the STYLE key 21 and successively the ten-key 2 are operated in the running (RUN) state with the 3rd track for chords set to the REC mode, there arises a need of writing a new style number into the 3rd track for chords. Accordingly, in this case, the following processing at step 129 is that a new style number is written into the 3rd track along with timing information with the pointer of the 3rd track incremented by one (n130). Otherwise, the processing exits the step n128 to return.

Figure 11:
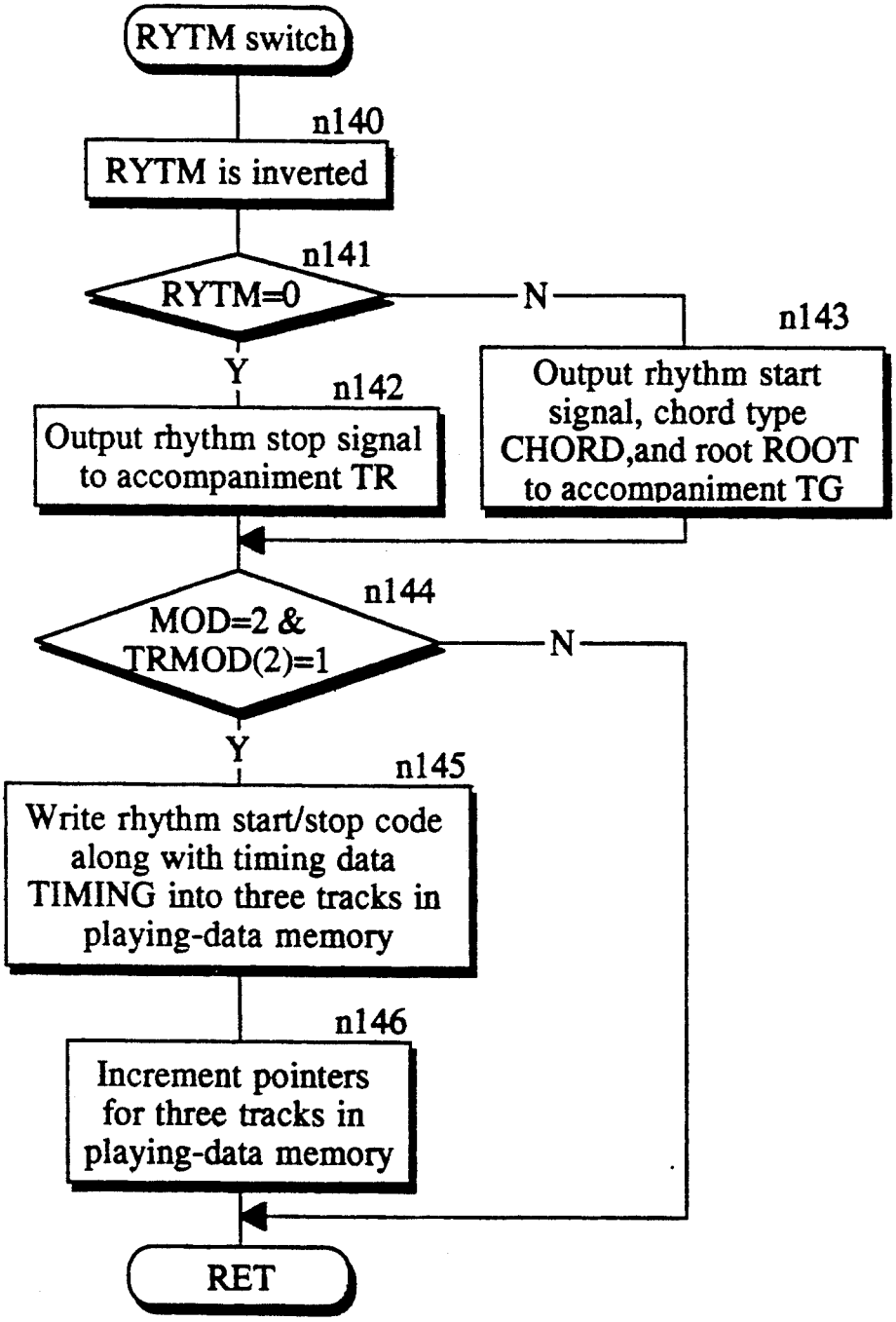

On the other hand, the operation involved when the RYTM switch 9 is turned on is as follows. When the RYTM switch 9 is turned on, the processing goes to step n19 in FIG. 6, executing the RYTM switch subroutine. The RYTM switch subroutine is given in FIG. 11.

When the RYTM switch 9 is turned on, the register RYTM is inverted at step n140. As shown in FIG. 4, with this register RYTM at "0" the rhythm state is in the NORMAL mode, while with the register RYTM at "1" it is in the RUN mode. At step n141, the register RYTM is decided, where if RYTM=0, a rhythm stop signal is fed to the accompaniment tone generator 36 at step n142. If RYTM=1, on the other hand, the processing goes to step n143, where a rhythm start signal, chord type data that has been set in the register CHORD, and root data that has been set in the register ROOT are fed to the accompaniment tone generator 36. When these signals are fed to the accompaniment tone generator 36, the sound system 40 will output accompaniment tones determined by the foregoing data. Subsequently, at step n144, it is decided whether or not the synthesizer is in the RUN mode and the 3rd track for chords is in the REC mode. If it is, there is a need of writing a rhythm start/stop code into the 3rd track for chords and therefore the processing goes to step n145. At the step, the rhythm start/stop code is written into the 3rd track along with timing information with the pointer for the 3rd track incremented by one (n146). At step n144, if the synthesizer is not in the RUN mode or if the 3rd track for chords is not in the REC mode, the processing will return as it is.

Through these steps, when the RYTM switch 9 is turned on in the RUN mode and the 3rd track for chords is in the REC mode, the rhythm start code or rhythm stop code is written into the 3rd track. Furthermore, when the state of RYTM=1 results from turning on the switch 9, the sound system 40 puts out accompaniment tones.

Figure 12:
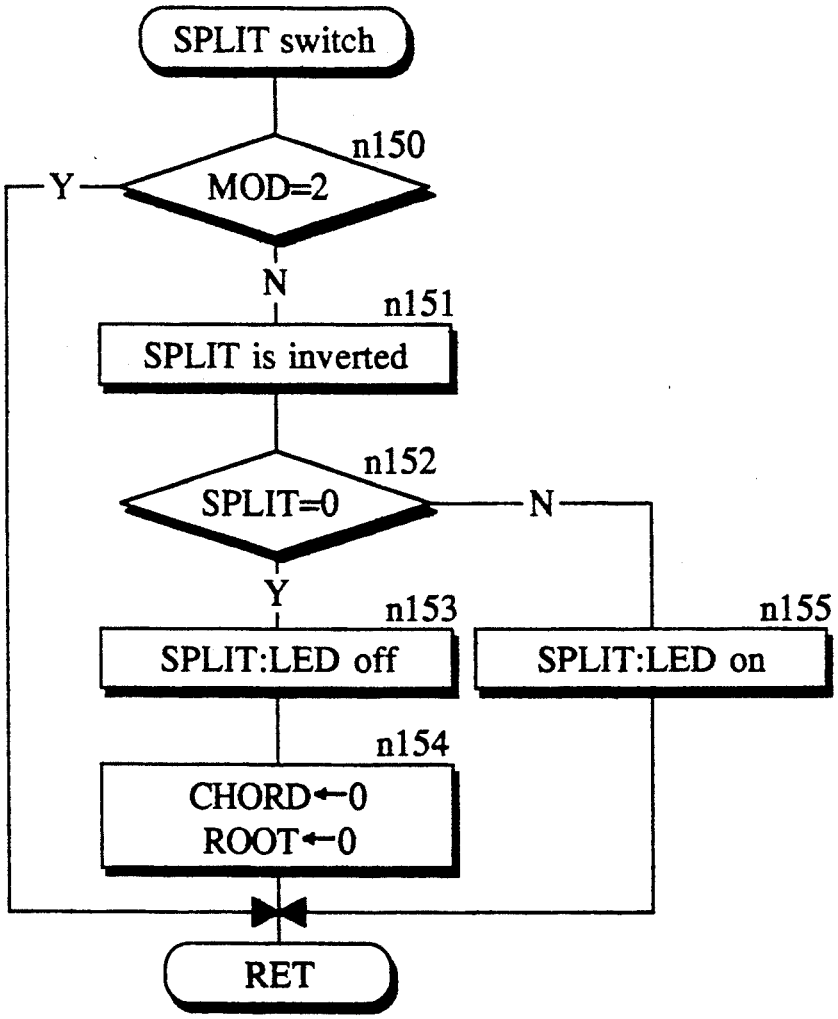

Next, the operation involved when the SPLIT switch 10 is turned on will be described. When the switch 10 is turned on, the processing goes to step n15 in FIG. 6, executing the SPLIT switch subroutine. The SPLIT switch subroutine is given in FIG. 12.

First, at step n150, the register MOD is decided. If MOD=2, i.e. the RUN mode is effective, no processing is effected. This means that the operation of the SPLIT switch 10 is ineffective in the RUN mode. When the SPLIT switch 10 is turned on in any mode other than the RUN mode, the processing goes to the steps of n151 and following. If SPLIT=0 results when the register is first inverted, the LED 13 is made to go out at step 153 and the registers CHORD and ROOT are each set to their initial value "0" so that the keyboard will be in the NORMAL mode. Since the accompaniment results in an invalid chord with the keyboard in the NORMAL mode, "0" is set to each register, which value is indicating that the chord is invalid. At the above step n152, if SPLIT = 1, the processing goes to step n155, making the LED 13 lit to show that the keyboard is in the SPLIT mode.

As described above, through the operations of subroutines shown in FIGS. 6 to 12, each operation in the paragraphs (1) (i), (1) (ii), (2) (i), (2) (ii), and (3) can be realized.

The description will now be directed to the operations involved when the keyboard 34 is operated.

Figure 13A:
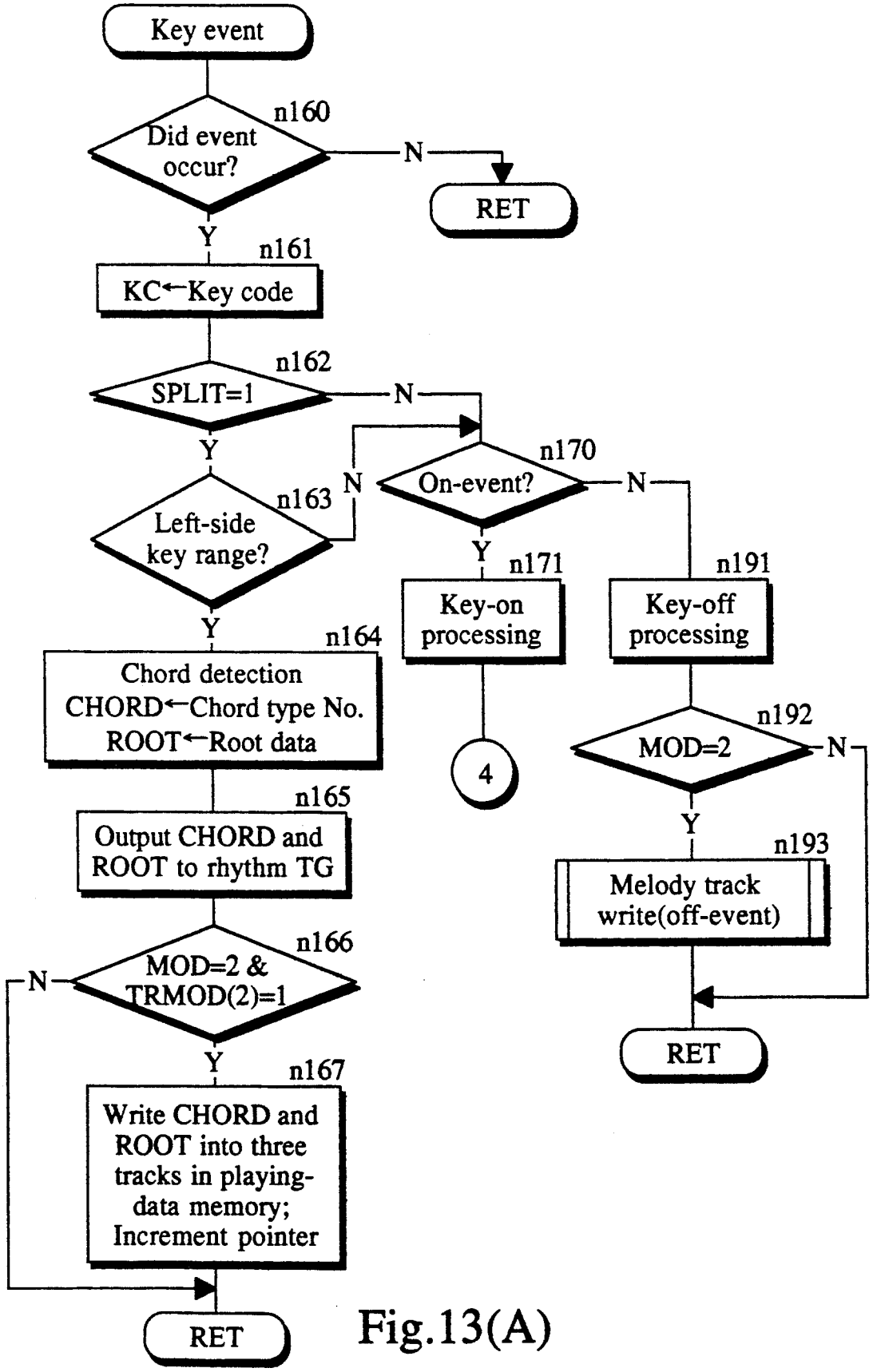
Figure 13B:
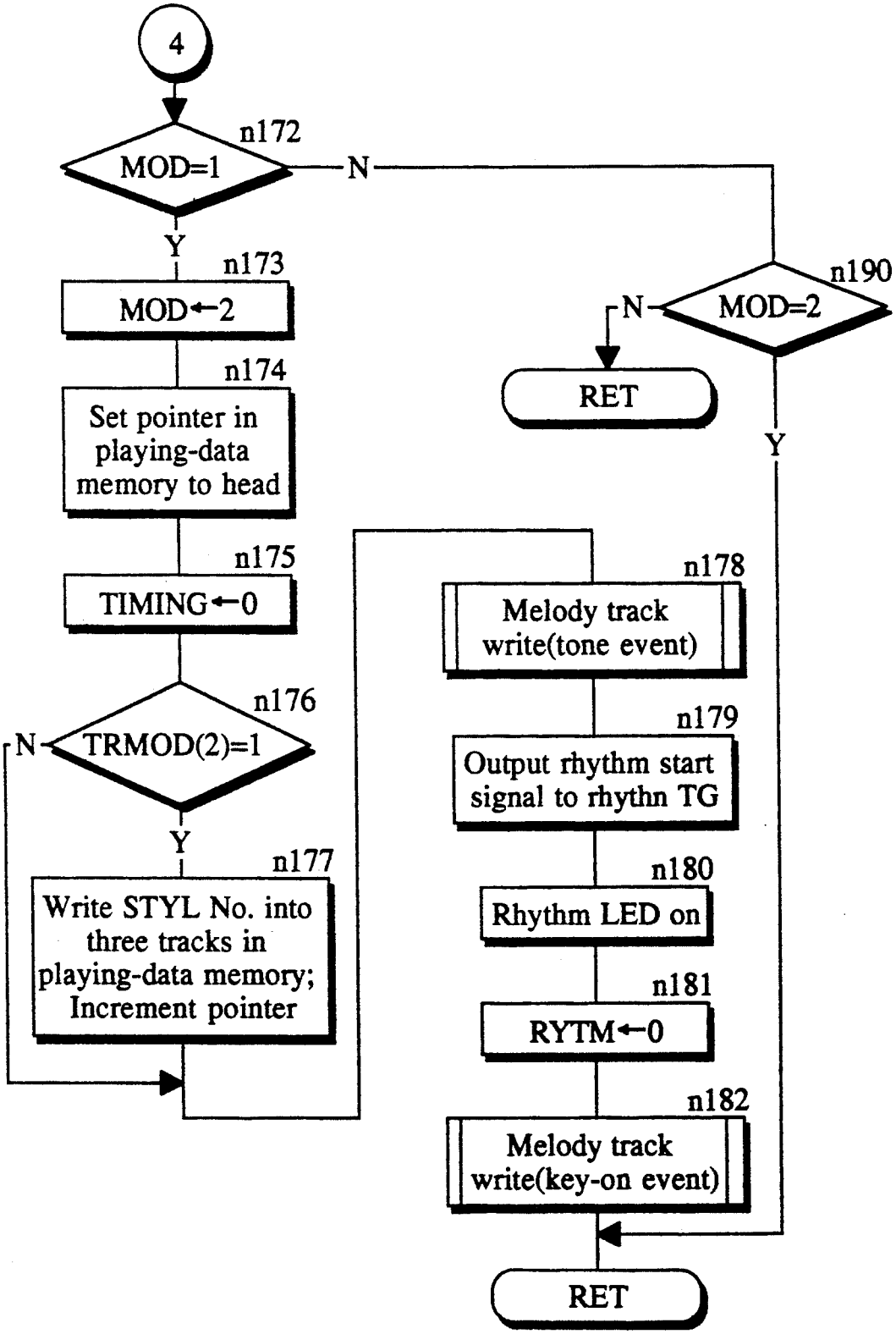

FIG. 13 shows the operation involved when the keyboard 34 is operated, causing a key event.

When a key event takes place, the key event is decided at step n160, and the key code that makes the key event is set to the register KC (n161). Then it is decided whether the register SPLIT is at "1" or "0" (n162). If SPLIT = 1, i.e. the keyboard 34 is in the SPLIT mode, it is subsequently decided whether the key code belongs to the left-side key range or the right-side key range (n162, n163). If the keyboard 34 is in the SPLIT mode and the key code is one in the left-side key range, the processing goes to the steps of n164 and following. If the keyboard 34 is in the NORMAL mode or if the key code is one in the right-side key range even though the keyboard is in the SPLIT mode, the processing goes to the steps of n170 and following.

If the keyboard 34 is in the SPLIT mode and the key code is one in the left-side key range, first at step n164 chord detection is performed according to the obtained key code. Then, a chord type number is set to the register CHORD according to the detected chord, while root data is set to the register ROOT. Further at step n165, the set data in the registers CHORD and ROOT are output to the rhythm tone generator 36. Subsequently, it is decided at step n166 whether or not the synthesizer is in RUN mode and the 3rd track for chords is set in the REC mode. If it is, the processing goes to step n167 to satisfy the need of writing the chord type number and root data into the 3rd track for chords. At step n167, the data of the register CHORD and that of the register ROOT are written into the 3rd track for chords, with the related pointer incremented by one.

On the other hand, if a key event occurs with the keyboard in the NORMAL mode, or if the key code is one in the right-side key range even though the keyboard is in the SPLIT mode, first at step n170 it is decided whether the key event is an on-event or off-event. For an on-event, the processing for key-on is executed at step n171. That is, a note-on signal, a key code stored in the register KC, and the like are fed to the tone generator 37, followed by the processing for tone generation. To do this, the assignment of tone-generating channels and others are carried out by a known method. Subsequently, it is decided whether the register MOD is at "1" or not, that is, whether the WAIT mode is effective or not. If a key-on event occurs in the WAIT mode, the register MOD is set to "2" at step n173 to set the running (RUN) state. More specifically, the pointer for the track set to the REC mode in the playing-data memory 33 is set to the leading head (n174), and the register TIMING for counting the timing is set to "0" (n174, n175). Then, it is decided whether the 3rd track for chords is in the REC mode or not (n176). If the track is in the REC mode, the style number currently set is written into the 3rd track with the related pointer incremented by one (n177). If the track is not in the REC mode, the processing skips to step 178, where the melody track write subroutine is executed. Event data written into the melody track at this stage is tone color event data. In addition, also for this tone color event data, a tone color number currently set is used.

Through the above steps of n173 to n178, tone color numbers and style numbers are written as the event data into the track set to the REC mode in the playing-data memory 33.

Subsequently, a rhythm start signal is fed to the rhythm tone generator 36 at step n179, with the LED 14 lit and further the register RYTM set to "1" (n179 to n181). Then, the processing goes to step n182, executing the melody track write subroutine. Event data written into the track at this stage is key-on event data.

If the register MOD is not set to "1" at step n172, that is, the synthesizer is not in the WAIT mode, the processing goes to step n190, where it is further decided whether the RUN mode is effective or not. If not, the NORMAL mode is effective, in which case the processing returns as it is. If the RUN mode is effective, the processing goes to step n182, executing the melody track write subroutine. More specifically, when a key event occurs in the RUN mode and the key code currently set is one which should be written as melody data, the processing goes to step n182 as it is, where the write processing of the key-on event data is executed.

Whereas the above description for the steps of n170 and following has been directed to the operations concerning on-event, the processing goes to step n191 when an off-event occurs. In this case, the key-off processing is executed (n191), causing the tone generation to be stopped, and it is decided at step n192 whether the RUN mode is effective or not. Then, if the RUN mode is effective, the processing goes to the step n193 of the melody track write subroutine, where the write processing is executed to a pertinent track. If the RUN mode is not effective, on the other hand, the processing will return as it is.

The operations of the key event subroutine in FIG. 13 described above can be summarized as follows.

When the keyboard 34 has been set to the SPLIT mode and moreover keys in the left-side key range are depressed, a chord type number and root data are written on condition that the 3rd track for chords is in the REC mode and moreover the whole system is set to the RUN mode. On the other hand, when the keyboard 34 is depressed in the NORMAL mode, or when keys in the right-side key range is depressed with the SPLIT mode effective, the following processings are executed depending on the mode setting state of the synthesizer. When the synthesizer is in the WAIT mode:

A tone color number and a style number is written into the leading head of the track set to the REC mode in the playing-data memory 33, effecting rhythm start. Further, key-on event data and/or key-off event data is written to the 1st or 2nd track for melodies. Still further, key-on processing and/or key-off processing is executed. When the synthesizer is in the RUN mode:

Key-on event data and/or key-off event data is written into the 1st or 2nd track for melodies, while key-on processing and/or key-off processing is executed. When the synthesizer is in the NORMAL mode:

In this case, although the key-on processing and/or key-off processing is executed, the write operation is not executed.

Figure 14:
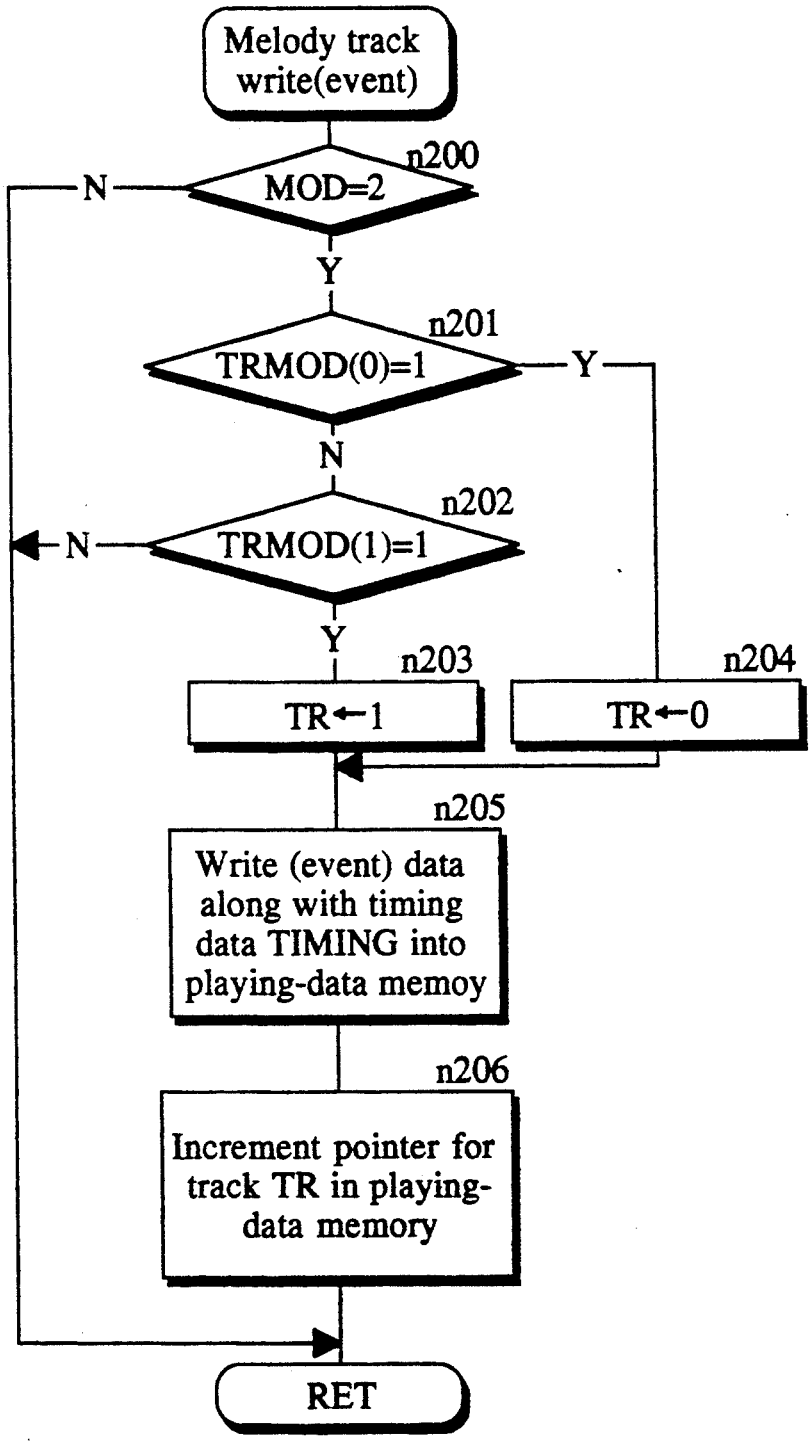
Figure 15:
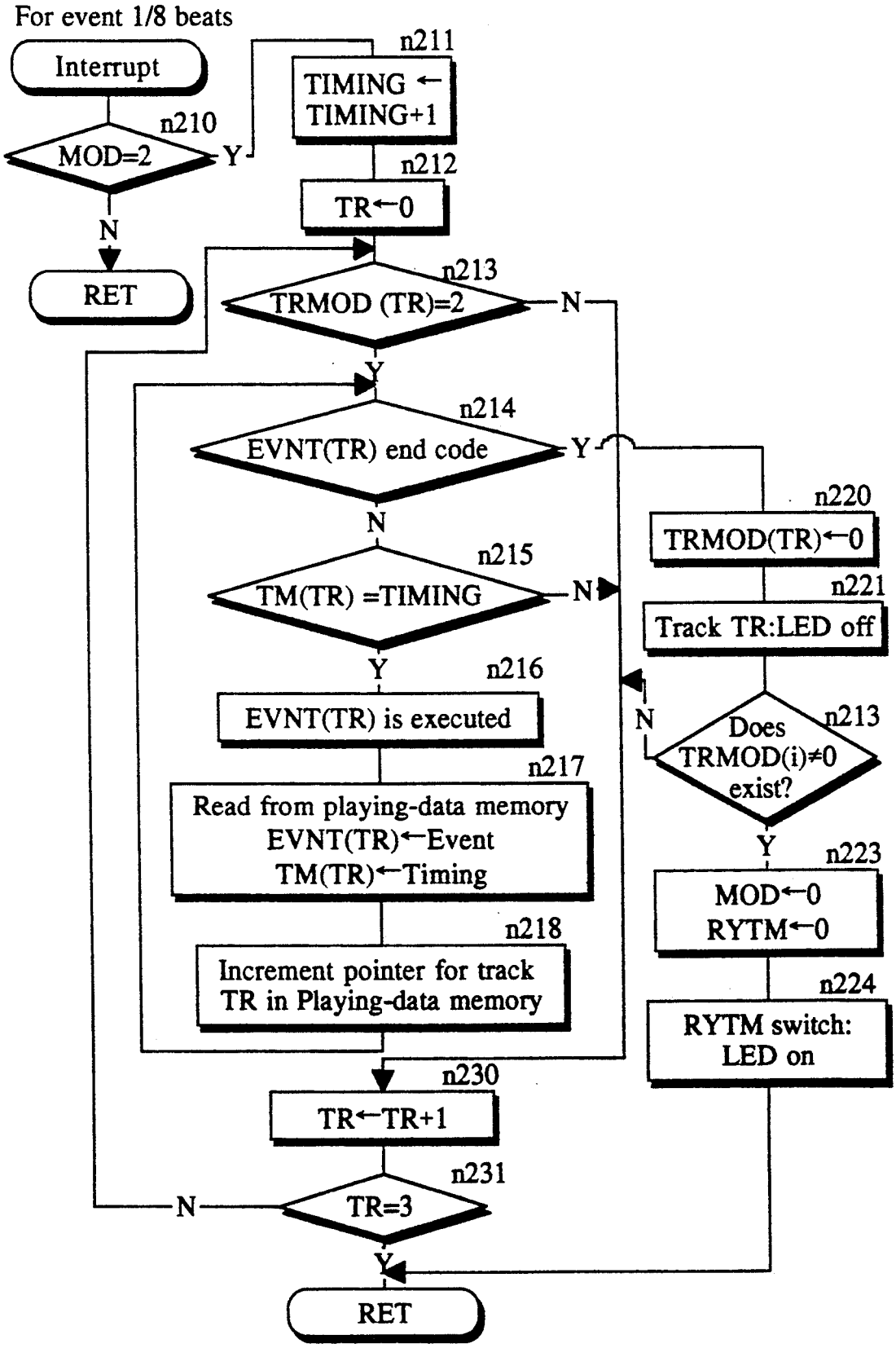

Now the description is turned to the melody track write subroutine for executing event data write operation to the 1st track or 2nd track for melodies. This subroutine is given in FIG. 14.

First, at step n200, it is decided whether the synthesizer is in the RUN mode or not. If it is, further at step n201 it is decided whether the 1st track for melodies is in the REC mode or not. If the 1st track has been set to the REC mode, the processing goes to step n204, where the register TR for specifying a track number is set to "0" so that the 1st track is specified by this register. On the other hand, if the 2nd track for melodies is set to the REC mode, the processing goes to steps n202 to n203, where the register TR is set to "1". Subsequently, event data is written into the track specified by the register TR, along with the timing data set in the register TIMING (n205), with the related pointer incremented by one.

Figure 10:
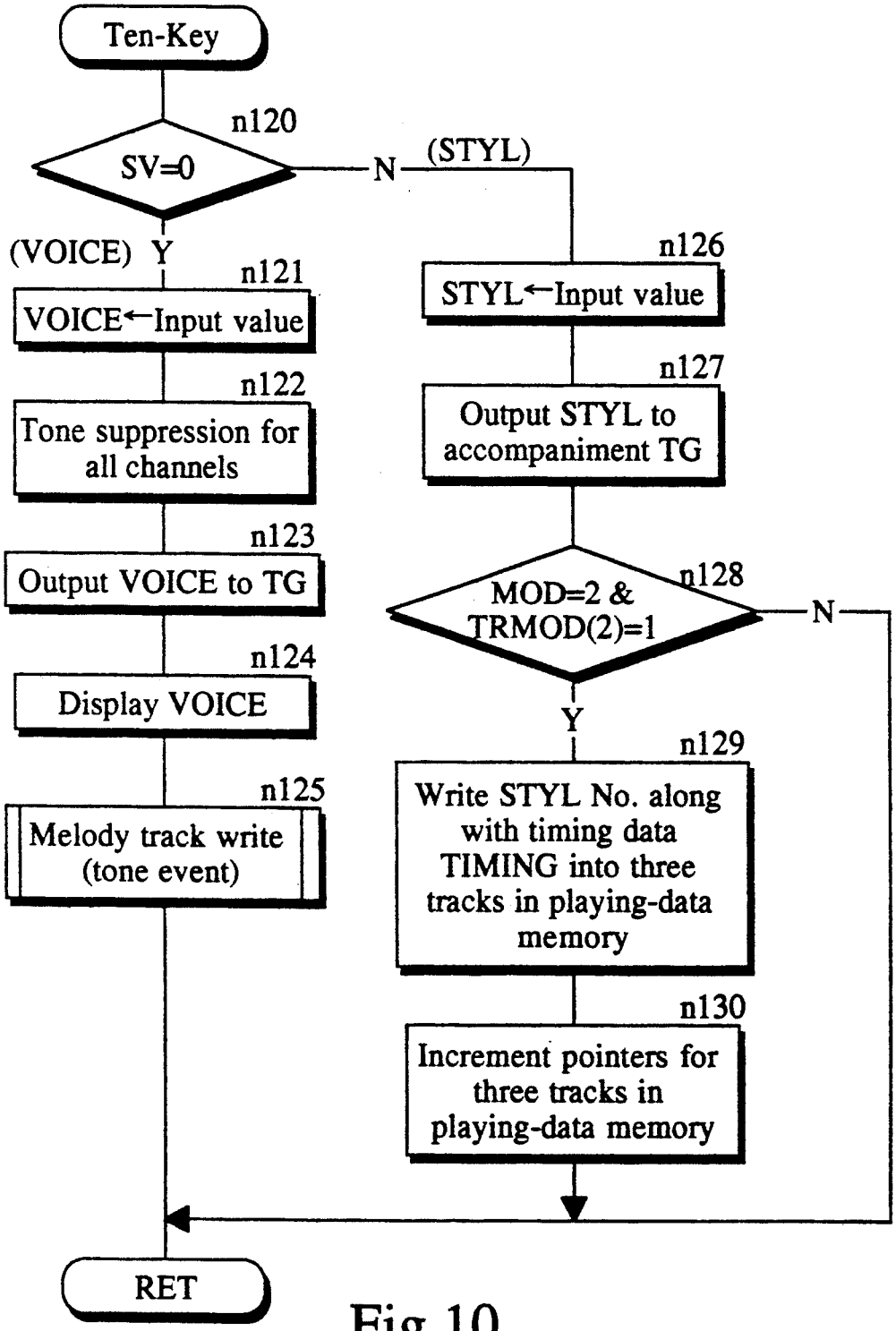

In the above operation, if the step n205 is executed, for example, at step n182 in FIG. 13, event data is key-on data, while if it is at step n125 in FIG. 10 event data is tone color event data.

Next described is the operation involved when interrupt is applied from the tempo clock circuit 38 to the CPU 30. This interrupt will be effected for every $\frac{1}{8}$ beats of the tempo that has been set by a tempo switch included in the switch group 11.

First, at step n210, it is decided whether the synthesizer is in the RUN mode or not. If it is, the processing goes to step n211, making the register TIMING incremented by one. That is, the count for timing is incremented by one. Then the register TR that specifies a track number is set to its initial value, "0" (n212). This is followed by step n213, where it is decided whether the set mode of the track specified by the register TR is in the PLAY mode or not. If not, it is unnecessary to execute event data. In this case, therefore, the processing goes to step n230, where the track specified by the register TR is incremented by one, turning to the decision at step n213 again. If the track specified by the register TR has been set to the PLAY mode, the processing further goes to step n214, where it is decided whether the data of the register EVNT (TR) is the end code or not. The register EVNT (TR) has stored event data read from the track specified by the register TR. For example, when the processing goes first to this step n214, event data, which should be first processed at step n53 in FIG. 7 or step n92 in FIG. 8, has already been set in the register EVNT (TR). If the event data stored in this register is not the end code, the processing successively goes to step n215, where it is decided whether or not the timing data also set in the register TM (TR) coincides with the count value of the register TIMING that counts the current timing. If not, the processing goes to step n230, where a succeeding track is specified. If the read event data is not the end code and moreover the read timing data is coincides with the current timing, the processing goes to step n216, executing the event. For example, if the event data is note-on data for instructing to start tone generation (the note-on data is equivalent to key-on data of the keyboard), a note-on signal, a key code, and the like are sent to the tone generator 37 for the processing of tone generation. If the event data is tone color number event data, in turn, a tone color number is sent to the tone generator 37. Thereafter, at step n217, playing-data to be processed is read out, event data is set to the register EVNT (TR), and timing data is set to the register TM (TR). Further, the pointer for the related track is incremented by one (n218). In this way, the steps of n214 and following are executed in succession. Thus, when read event data coincides with the end code, the processing moves from step n214 to n220.

The steps of n220 and following are those involved upon termination of a playback. First, the track specified by the register TR is set to the STOP mode (n220), while the LED 12 corresponding to the track is mode to go out (n221). Further, at step n222, it is decided whether or not the other tracks include one that is not in the STOP mode. If any such track is included among the others, the processing will return to step n230, executing the operations of the above steps of n213 and following. If it is decided at step n222 that all the tracks are in the STOP mode, which means that the playbacks in all the tracks have been completed, the processing goes to step n223, where the synthesizer is set to the NORMAL mode and the rhythm state is also set to the NORMAL mode. Then the LED 14 for the RYTM switch is made to go out (n224), and the processing returns.

To sum up, the steps of n223 and n224 are those for automatically setting the synthesizer to the NORMAL mode upon completion of playbacks in all the tracks.

In addition, although the number of tracks is three in the above embodiment, it is of course not limited to three. Further, the data format written into each track is not limited to the one of event form such as in the embodiment, but may be of such a type that data is stored with pitch and length of tones. Although it is arranged in the embodiment that when the PLAY switch 7 is turned on in the NORMAL mode, all of the then stored tracks are specified and set to the PLAY mode, the arrangement may also be such that only predetermined tracks are specified and set to the PLAY mode. In this case, such an arrangement may be added that when the track specified at that time is not in record state, any other track is specified or the specifying is no longer performed. Furthermore, although it is arranged in the embodiment that when both the REC switch 6 and the PLAY switch 7 are simultaneously one-touch operated in the NORMAL mode, the 1st and 3rd tracks are specified and set to the REC mode, the arrangement may also be such that any track left free at the time of the one-touch operation is specified and set to the REC mode.

In the above-described embodiment, the operation of only a track switch will cause a track to be specified and set to the PLAY mode at the same time. That is, a track switch serves also as a mode switch for setting the PLAY mode. However, the track switch may be adapted to be used only for specifying a track and there may independently be provided a mode switch for setting the specified track to the PLAY mode. According to the present invention, one-touch operation allows a plurality of tracks to be specified and set to the REC mode, thus advantageously improving the operability of the system. In particular, when the number of tracks involved is very large and that of tracks set to the REC mode by one-touch operation is also great, the maneuverability can greatly be enhanced. Furthermore, it is also possible to set certain tracks to the PLAY mode with one-touch operation, hence the improved operability to more advantages.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. An electronic musical instrument comprising:

automatic performance data memory means, divided into a plurality of tracks, for storing automatic performance data for each of the tracks;

record mode setting means for specifying predetermined plural tracks of said plurality of tracks simultaneously, wherein the number of predetermined tracks is less than all the tracks, and for setting the predetermined plural tracks to the record mode; and writing means for writing automatic performance data simultaneously into the tracks specified by the record mode setting means.

2. The electronic musical instrument as claimed in claim 1, wherein said plurality of tracks include a track for melodies and a track for chords, and wherein said predetermined plural tracks specified by said record mode setting means are the track for melodies and the track for chords.

3. The electronic musical instrument as claimed in claim 2, further comprising:

operation means for forming said automatic performance data when operated by a performed; and means for dividing an operation area of the operation means into a plurality of areas when said tracks are specified by said record mode setting means, converting automatic performance data formed in a first divided area to chord data, and setting automatic performance data formed in a second divided area to melody data; and wherein said writing means writes the chord data into said track for chords and writes the melody data into said track for melodies.

4. The electronic musical instrument as claimed in claim 3, wherein said operation means comprises a keyboard and wherein said first divided area is a left side area thereof and said second divided area is a right side area thereof.

5. An electronic musical instrument comprising:

automatic performance data memory means, divided into a plurality of tracks, for storing automatic performance data for each of the tracks;

play mode setting means for specifying a predetermined at least one track out of said plurality of tracks, wherein the number of predetermined tracks is less than all the tracks, and for setting the track to a play mode; and reading means for reading automatic performance data from the track specified by the play mode setting means.

6. The electronic musical instrument as claimed in claim 5, wherein said predetermined track is a track in which the automatic performance data has already been recorded when said play mode setting means is operated.

7. The electronic musical instrument as claimed in claim 5, further comprising track switch means for specifying said tracks individually and for setting a specified track to the play mode.

8. An electronic musical instrument comprising:

automatic performance data memory means, divided into a plurality of tracks, for storing automatic performance data for each of the tracks;

one-touch record mode setting means for specifying a track with a one-touch operation and for setting the track to a record mode;

one-touch play mode setting means for specifying a track with a one-touch operation and for setting the track to a play mode; and means for writing or reading automatic performance data to or from the track specified by the one-touch record mode setting means or the one-touch play mode setting means, respectively.

9. The electronic musical instrument as claimed in claim 8, further comprising:

track switch means for specifying an arbitrary track; and record switch means for setting the track specified by the track switch means to the record mode when simultaneously operated along with the track switch means;

wherein said one-touch record mode setting means is effective with simultaneous operation of said one touch play mode setting means and the record switch means.

10. The electronic musical instrument as claimed in claim 9, wherein said track switch means sets a track specified by the track switch means to said play mode when said track switch means is operated independently.

* * * * *